US005690067A

United States Patent [19]

Reckzügel

[11] Patent Number: 5,690,067

[45] Date of Patent: Nov. 25, 1997

[54] ARRANGEMENT FOR THE OPERATION OF VALVES OF INTERNAL COMBUSTION ENGINE

[75] Inventor: Christoph Reckzügel, Hohenstadt, Germany

[73] Assignee: Mercedes-Benz AG, Stuttgart, Germany

[21] Appl. No.: 795,517

[22] Filed: Feb. 5, 1997

[30] Foreign Application Priority Data

Feb. 10, 1996 [DE] Germany ..... 196 04 943.1

[51] Int. Cl.[6] ..... F01L 1/26; F01L 13/00; F02D 13/06

[52] U.S. Cl. ..... 123/90.16; 123/90.46; 123/198 F; 123/90.23

[58] Field of Search ..... 123/90.15, 90.16, 123/90.17, 90.22, 90.23, 90.39, 90.46, 198 F

[56] References Cited

U.S. PATENT DOCUMENTS

| | | | |
|---|---|---|---|
| 5,456,225 | 10/1995 | Oikawa et al. | 123/90.16 |
| 5,515,820 | 5/1996 | Sugimoto et al. | 123/90.16 |
| 5,529,032 | 6/1996 | Oikawa et al. | 123/90.16 |
| 5,592,907 | 1/1997 | Hasebe et al. | 123/90.16 |

FOREIGN PATENT DOCUMENTS

| | | |
|---|---|---|
| 0 265 281 | 8/1990 | European Pat. Off. . |
| 34 15 245 | 12/1984 | Germany . |
| 42 21 134 | 7/1993 | Germany . |
| 43 26 332 | 2/1995 | Germany . |

*Primary Examiner*—Weilun Lo
*Attorney, Agent, or Firm*—Klaus J. Bach

[57] ABSTRACT

In an arrangement for operating the intake and exhaust valves of an internal combustion engine wherein valve actua-ting and coupling levers are pivotally supported in side-by-side relationship on a lever support shaft extending parallel to an overhead cam shaft, and the coupling and valve actuating levers have guide bores receiving a coupling bolt so as to be movable into and out of a coupling lever and valve actuating lever coupling relationship and further a hydraulic valve clearance compensating element is disposed in a bore formed at the end of the actuating lever adjacent a valve, the guide bore center axis is spaced from the lever support shaft axis by a distance which is greater than the distance between the guide bore center axis and the axis of the valve clearance compensating element, and the support lever shaft axis, the center axis of the guide bores and the engagement line of the cam define approximately an isosceles triangle whose sides of equal length are formed by the distance between the engagement line and the lever support shaft axis and the distance between the cam engagement line and the guide bore center axis and the camshaft is disposed at least partially above the valve actuating and coupling levers.

5 Claims, 3 Drawing Sheets

ARRANGEMENT FOR THE OPERATION OF VALVES OF INTERNAL COMBUSTION ENGINE

BACKGROUND OF THE INVENTION

The invention relates to an arrangement for the operation of valves of an internal combustion engine.

DE 42 21 134 C1 discloses a valve operating arrangement which has a plurality of motion transmission members (actuating levers and rocker arms) for opening and closing the valves. These motion transmission members are mounted pivotably relative to one another on a rocker arm support shaft. A camshaft with cams is provided for actuating the motion transmission members. A hydraulic valve play adjustment element is arranged on that side of the rocker arm which faces the valve. Formed in the motion transmission members are guide bores which may be aligned and which receive a coupling bolt. The coupling bolt is axially moved between adjacent guide bores by means of an actuating device to permit selective coupling of the motion transmission members.

Reference is also made to the publication EP 0 265 281 B1 for general technical background information.

It is an object of the present invention to provide an efficient valve operating arrangement for an internal combustion engine with a coupling lever adapted to be coupled with a valve actuating lever by a coupling bolt.

The force for operating the coupling bolt and the forces required for the actuation of the motion transmission members should be as low as possible.

SUMMARY OF THE INVENTION

In an arrangement for operating the intake and exhaust valves of an internal combustion engine wherein valve actuating and coupling levers are pivotally supported in side-by-side relationship on a lever support shaft extending parallel to an overhead cam shaft, and the coupling and valve actuating levers have guide bores receiving a coupling bolt so as to be movable into and out of a coupling lever and valve actuating lever coupling relationship and further a hydraulic valve clearance compensating element is disposed in a bore formed at the end of the actuating lever adjacent a valve, the guide bore center axis is spaced from the lever support shaft axis by a distance which is greater than the distance between the guide bore center axis and the axis of the valve clearance compensating element, and the support lever shaft axis, the center axis of the guide bores and the engagement line of the cam define approximately an isosceles triangle whose sides of equal length are formed by the distance between the engagement line and the lever support shaft axis and the distance between the cam engagement line and the guide bore center axis and the camshaft is disposed at least partially above the valve actuating and coupling levers.

With the relative arrangement of the valve actuating and coupling lever support shaft of the motion transmitting means (roller or sliding face) and the guide bore for the coupling bolts, the coupling bolt moving force, with the motion transmission members coupled, the axial forces required to move the coupling bolt are reduced appreciably in comparison with the known arrangements. The reason for this is inter alia, that the guide bore for the coupling bolt is arranged as much as possible near the valve end of the valve actuating lever.

Also, by virtue of the favorable lever ratios of the motion transmission members (actuating levers and coupling levers) of the arrangement according to the invention, all internal forces (coupling bolt forces, lever and lever shaft forces) generated by the external forces (valve forces, cam forces) are relatively small, thus resulting in relatively little wear and friction losses. Furthermore, the components can be given smaller dimensions and made lighter because of the relatively low bolt and lever forces. As a result of the lower forces and the consequently lower pressure per unit area, a reliable lubricating film is formed between the relative moving parts of the arrangement.

One advantage of the arrangement according to the invention is that a highly compact design is achieved.

The invention and its advantages will be described below in greater detail on the basis of the accompanying drawings.

DESCRIPTION OF A PREFERRED EMBODIMENT

Figure 1:
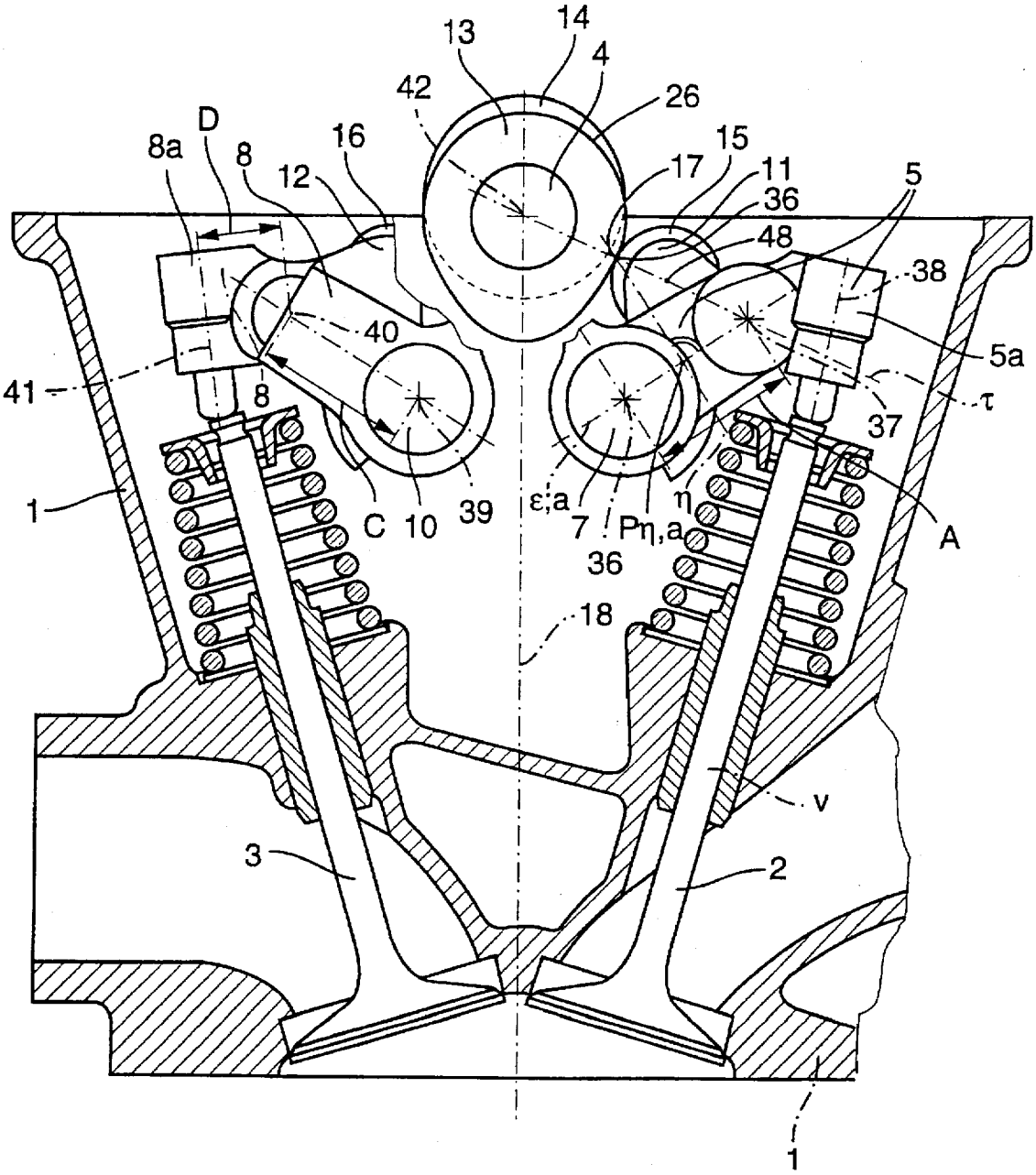
FIG. 1 is a cross-sectional view of a cylinder head of an internal combustion engine with an an actuating lever and coupling lever arrangement according to the invention for the actuation of inlet and outlet valves and with a camshaft arranged in the cylinderhead.

FIG. 1 shows a cross-section through a cylinder head 1 of a multi-cylinder internal combustion engine, which is not shown. It depicts an arrangement for the operation of inlet valves 2 and outlet valves 3 by means of a plurality of motion transmission members for opening and closing the valves 2, 3. The motion transmission members are described in greater detail below.

The arrangement shown serves mainly for selective cylinder cut-off, by which, during operation of the internal combustion engine, cylinders, selectable in a controlled manner as a function of engine operating parameters, do not participate for specific time periods in the charge cycle of the internal combustion engine as a result of a time-controllable suppression of valve actuation.

Mounted in the cylinder head 1, for each cylinder are two inlet valves 2 and two outlet valves 3 driven by a single camshaft 4. The camshaft 4 is supported on the cylinder head 1 so as to extend in the direction of the longitudinal axis of the cylinder head essentially above the inlet valves 2 and the outlet valves 3. The cross-sectional view of FIG. 1 shows one inlet valve 2 and one outlet valve 3. However, there are two inlet and two outlet valves for each cylinder.

The motion transmission members for opening and closing the two inlet valves 2 comprise, for each cylinder, actuating levers 5 and 6 (see FIG. 3) arranged between the camshaft 4 and each inlet valve 2. The actuating levers 5, 6 are designed as rocker levers and are mounted rotatably on a lever support shaft 7. Furthermore, the motion transmission members comprise a coupling lever 11 which is arranged between the actuating levers 5 and 6 and is pivotally supported on the lever support shaft 7.

In a similar way, the motion transmission members for opening and closing the outlet valves 3 comprise actuating levers 8 and 9 which are arranged between the camshaft 4 and the outlet valves 3. They are designed as rocker levers and are pivotally supported on a lever support shaft 10. A coupling lever 12, arranged between the actuating levers 8 and 9 on the lever support shaft 10, is mounted on the latter so as to be pivotable relative to the actuating levers 8, 9. The two lever support shafts 7, 10 extend in the longitudinal direction of the engine cylinder head.

Each actuating lever 5, 6 and 8, 9 possesses, at its valve-side end, a receptacle for a hydraulic valve clearance compensating elements 5*a*, 6*a* and 8*a*, 9*a*.

One cam 13 is provided for the operation of the two inlet valves 2 and one cam 14 is provided for the operation of the two outlet valves 3. The cams 13, 14 roll, one in each case, in engagement with the rollers 15, 16 mounted rotatably on the respective coupling levers 11 and 12. The engagement line 17 between the cam 13 and roller 15 can be seen (as a point) in FIGS. 1 and 2. Instead of the rollers 15, 16, other means can be provided for the transmission of the cam force $F_{cam}$ (see FIG. 2), for example slide faces.

Figure 2:
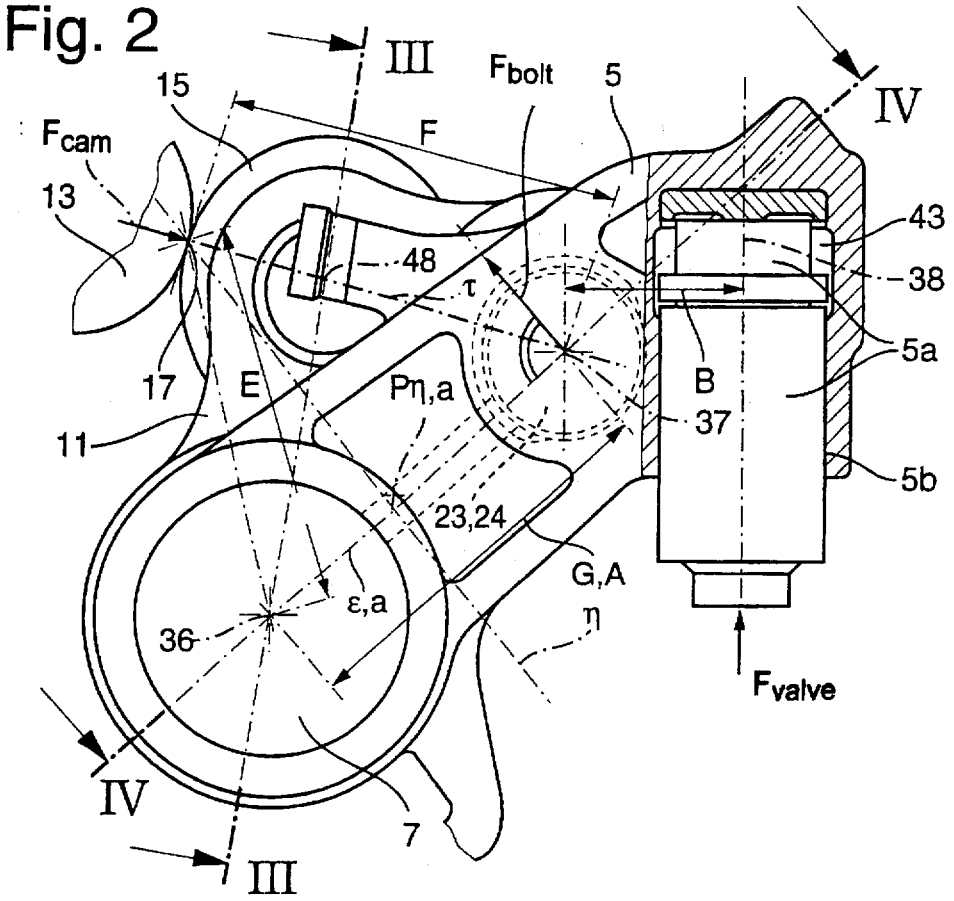
FIG. 2 shows the actuating lever and coupling lever in a coupled state and a hydraulic valve clearance compensating element mounted at the end of the actuating lever adjacent the valve.

For a more detailed explanation, FIG. 2 shows the coupled actuating levers 5, 6 and coupling lever 11 together with the hydraulic valve clearance compensating element 5*a*. Identical components from FIG. 1 are designated by the same reference numeral. FIG. 2 also shows a cam force $F_{cam}$, a bolt force $F_{bolt}$ and a valve force $F_{valve}$, the forces being explained in greater detail in FIG. 5.

Figure 3:
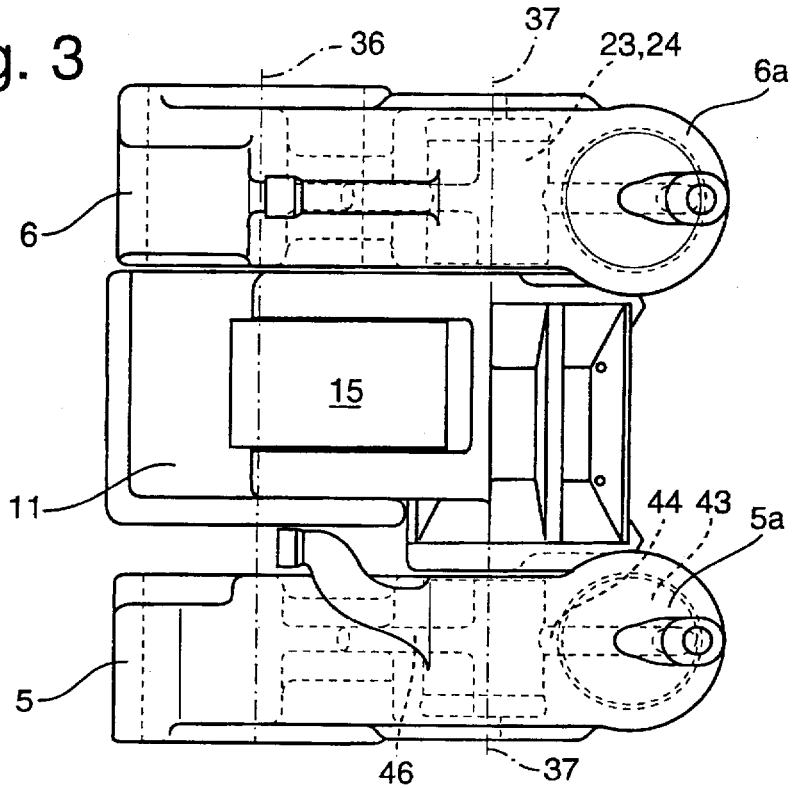
FIG. 3 is a sectional view taken along line III—III of FIG. 2.
Figure 4:
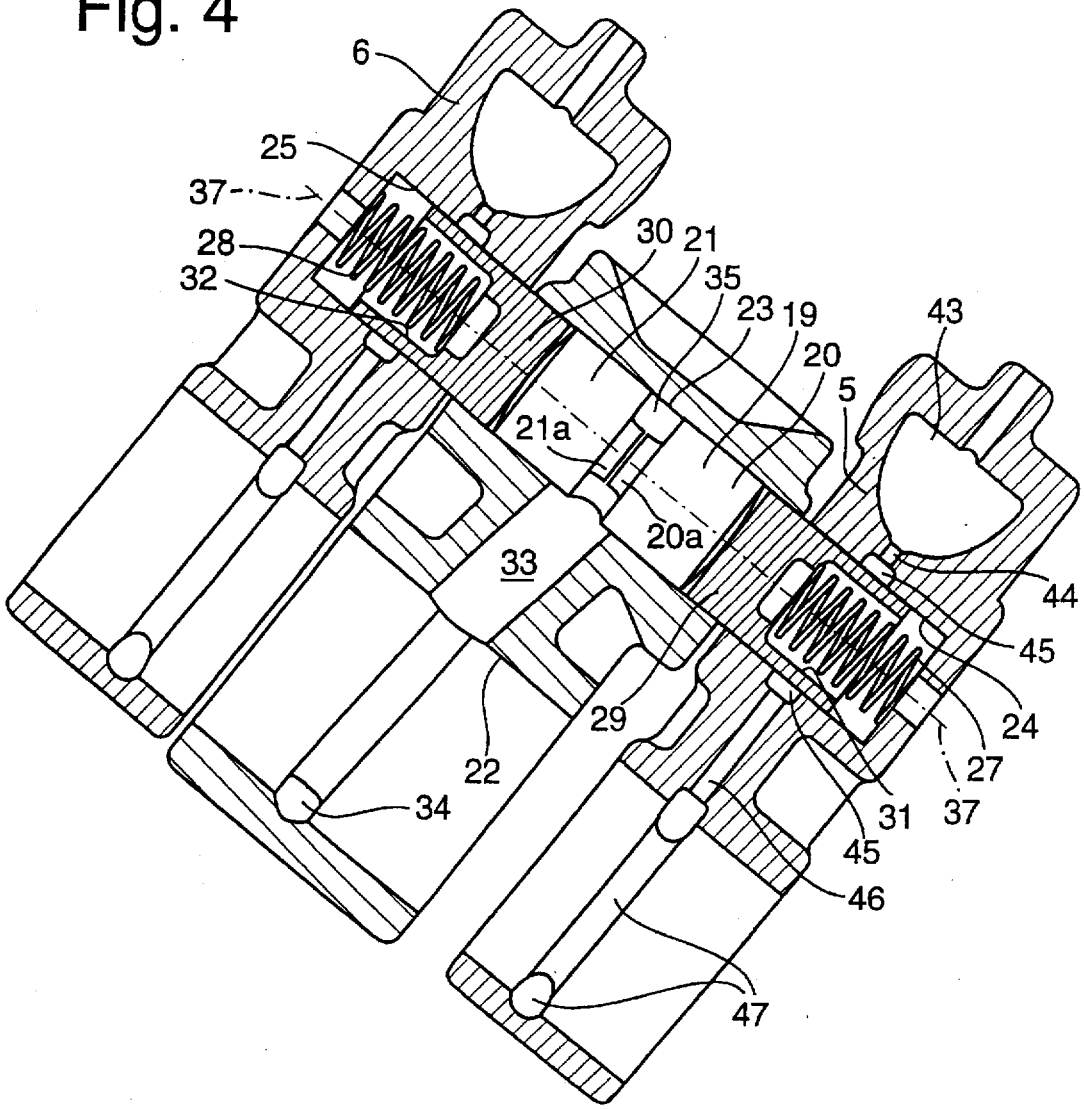
FIG. 4 is a sectional view taken along line IV—IV of FIG. 2.

FIGS. 3 and 4 show sections III—III and IV—IV indicated in FIG. 2. Identical components of FIGS. 1 and 2 are designated by the same reference numerals.

As can be seen in FIG. 1, the transmission members for valve actuation are arranged symmetrically in relation to a vertical cylinder axis 18. The invention is described below with reference to the valve operating mechanism located on the inlet-valve side. The valve operating mechanism for the outlet valves is designed in a similar way.

The actuating levers 5 and 6 are coupled to the associated coupling lever 11 by an actuating arrangement 19 comprising two operating pistons 20, 21 which act as uncoupling elements. They are supported longitudinally movably in a guide bore 23 formed in the coupling lever 11 and extending parallel to the lever support shaft 7 (see FIG. 4).

Furthermore, the actuating arrangement 19 comprises springs 27, 28 described in greater detail below.

A guide bore 24 is provided in the valve actuating lever 5 and a guide bore 25 is provided in the valve actuating lever 6. The two guide bores 24, 25 are alignment with the guide bore 23 in the coupling lever 11 at a particular moment determined by the camshaft position, specifically when, with the inlet valves 2 closed, the coupling lever 11 bears on a base circle 26 of the associated cam 13. In each case a coupling bolt 29 or 30, can be displaced under the force of the spring 27 or 28, in the guide bore 24 or 25, respectively, in parallel with the lever support shaft 7 in the direction of the longitudinal axis of the coupling bolt and can extend into the guide bore 23 of the coupling lever 11.

The coupling bolt 29 includes a recess 31 for receiving the spring 27 the coupling bolt 29, and the coupling bolt 30 includes a recess 32 for receiving the spring 28.

The two operating pistons 20 and 21 each have, on the sides facing one another, a central projection 20*a* or 21*a*, the diameter of which is clearly smaller than that of the guide bore 23. Approximately in the middle of the guide bore 23, an oil passage 33 formed in the coupling lever 11 opens into the guide bore 23 so that pressurized oil can be supplied to it via an annular oil passage 34 arranged in the bearing structure of the coupling lever 11 and connected to the lubricating circuit of the internal combustion engine. When the operating pistons 20, 21 are pressed together, the projections 20*a*, 21*a* and the guide bore 23 form an annular oil channel 35 which is in communication with the oil passage 33.

When the two valve actuating levers 5 and 6 are coupled to the coupling lever 11 (normal operation of the internal combustion engine), the oil in the passages 33, 34 and the oil channel 35 is pressureless and the two coupling bolts 29, 30 are pressed into the guide bore 23 of the coupling lever 11 by the springs 27, 28, until the two control pistons 20, 21 abut one another within the coupling lever 11. The coupling bolts 29 and 30 then extend into the coupling lever 11 and couple the valve actuation levers 5 and 6 with the coupling lever 11. When the coupling lever 11 is then actuated by the cam 13, the valve actuating levers 5 and 6 are also actuated so that the inlet valves 2 are opened against the force of the valve springs 2'.

When it is desired to uncouple the two valve actuating levers 5, 6 from the coupling lever 11 (cylinder cut-off), pressure is applied to the oil passages and channel 33–35 so that the operating pistons 20, 21 move the coupling bolts 29, 30 out of the guide bore 23 against to the force of the springs 27, 28, whereby the coupling bolts 29, 30 are fully disengaged from the coupling lever 11. Consequently, when the coupling lever 11 is pivoted by the cam 13, the coupling lever 11 pivots relative to the two actuating levers 5, 6 which remain in a closed valve position. In this operating state, therefore, the coupling lever 11 is idly pivoted on the support lever shaft 7, while the inlet valves 2 remain closed by the valve springs. In order to prevent the operating pistons 20, 21 from jamming during the movement of the coupling lever 11 relative to the actuating levers 5, 6, the end faces of the operating pistons 20 and 21 adjacent the coupling bolts 29 and 30 are bevelled.

Coupling and uncoupling of the outlet valves 3 via the valve actuating levers 8, 9 and the coupling lever 11 take place in a similar way.

With the inlet valves closed, the guide bores 24, 25 for the coupling bolts 29 and 30 in the two valve actuating levers 5, 6 (see FIG. 4) are in alignment, so that the guide bores 24, 25 have a common center-axis 37.

With the actuating levers 5, 6 designed as rocker levers (see FIGS. 1 and 2), a distance A between the axis of rotation 36 of the lever support shaft 7 and the center-axis 37 of the guide bores 24, 25 is substantially greater than the shortest distance B between the center-axis 37 of the guide bores 24, 25 and the longitudinal axis 38 of the valve clearance compensating element 5*a*, 6*a*. The distance B is therefore the distance between two skew straight lines (center-axis 37 and longitudinal axis 38), whereas the distance A is the distance between two parallel straight lines (axis of rotation 36 and center axis 37). In a similar way, in the case of the exhaust valve actuating levers 8, 9, an axial distance C between the axis 39 of the lever support shaft 10 and the axis 40 (FIG. 1) of the guide bores is greater than the shortest distance D between the axis 40 of the guide bores and the longitudinal axis 41 of the valve clearance compensating element 8*a*, 9*a*.

When a valve actuating lever 5, 6 is coupled with the coupling lever 11, the relative arrangement of the lever support shaft 7, the motion transmission means (roller 15) and guide bores 24, 25 is defined, starting from a straight line "a" which lies in the cross-sectional plane of the cylinder head 1 and which intersects the axis of rotation 36 of the lever support shaft 7 and the center axis 37 of the guide bores 24, 25 as follows.

With the motion transmission members coupled, the coupling lever 11 is connected to the motion transmission means (roller 15) which is rolling on the cam 13 along the engagement line 17. A normal plane $\eta$ receiving the engagement line 17 is disposed normal to a plane $\epsilon$, defined by the axis 36 of the lever support shaft 7 and the straight line "a", between the axis 36 of the lever support shaft 7 and the axis 37 of the guide bores 24, 25. The normal plane $\eta$ is thus intersected by the straight line a at a point $P_{\eta,a}$ which is located between the axis 36 of the lever support shaft 7 and the center axis 37 of the guide bore.

With the valve actuating levers 5, 6 coupled, the roller 15 is disposed between the cam 13 and the guide bore 24, 25, as seen in the longitudinal direction of the cylinderhead. The camshaft axis 42, the engagement line 17, the center axis 37 of the guide bores 24, 25 and the axis 48 of the roller 15 all lying approximately in one plane $\tau$.

When the motion transmission members are coupled, the distances E, F, G between the axis 36 of the lever support shaft 7, the center axis 37 of the guide bores 24, 25 and the engagement line 17 form approximately an equilateral triangle. In an embodiment of the invention which is not shown, these distances E, F, G can also form an isosceles triangle, the sides of equal length being formed preferably by the distances E between the engagement line 17 and axis 36 of the lever support shaft 7 and the distance F between the engagement line 17 and center axis 37. The distance G between the axis 36 and center axis 37 depends on the dimensioning of the valve drive and is preferably between 15 and 60 mm.

The receiving bore **5*b* for the hydraulic valve clearance compensating element 5*a*, which is formed in the valve actuating lever 5, is located adjacent to the guide bore 24 of the valve actuating lever 5. An oil space 43 is provided in the receiving bore 5 which is connected via an oil passage 44 to an annular oil passage 45 in the guide bore 24. The annular oil passage 45 in the guide bore 24 is connected via a further oil passage 46 to an oil passage 47 extending in the lever support shaft 7. Pressurized oil of the lubricating oil circuit of the internal combustion engine is supplied to the hydraulic valve clearance compensating element via the oil passages 44–47. The receiving bores 6*b*, 8*b* and 9*b*** together with the oil supply passages are designed in a similar way.

Figure 5:
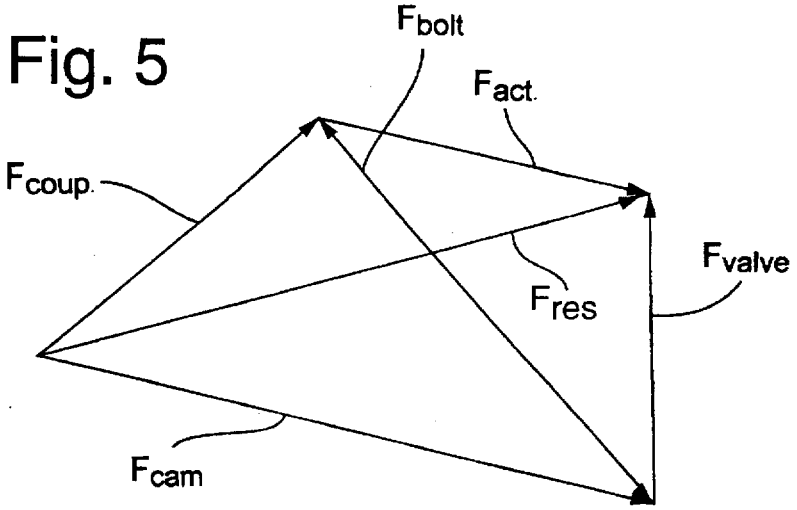
FIG. 5 is a simplified representation of the force relationships for the arrangement according to the invention.

FIG. 5 shows the force relationships, with the valve actuating lever 5 and coupling lever 11 coupled, in a simplified two-dimensional view and in a position in which the valve axis v is parallel to the axis 38 of the valve clearance compensating element **5*a***.

The line of action of the cam force (see also FIG. 2) is predetermined by the direction normal to the tangential plane to the rolling surface of the roller 15 at the point of contact with the cam 13. The line of action of the bolt force $F_{bolt}$ (see also FIG. 2) is normal to the straight line a. With the above simplification, the line of action of the valve force $F_{valve}$ extends in the direction of the longitudinal axis 38 of the valve clearance compensating element **5*a***.

The design parameters of the internal combustion engine essentially determine the dimensioning of the valves and consequently the magnitude of the required valve force $F_{valve}$. The magnitudes of the remaining forces are determined by the geometrical conditions and the constraints of the valve drive selected. In the device according to the invention, the lever-axis force $F_{act}$ of the actuating lever 5 and the lever-axis force of the coupling lever 11 $F_{coup}$ as well as the resultant lever-axis force $F_{res}$ can be ascertained from the forces thus predetermined. The bolt force $F_{bolt}$ is obtained from the force triangle comprising the valve force $F_{valve}$ and the lever-axis force $F_{act}$ of the actuating lever 5 or from the force triangle comprising the cam force $F_{cam}$ and the lever-axis force $F_{coup}$ of the coupling lever 11. It can be seen that the resultant lever-axis force $F_{res}$ is only slightly greater than the bolt force $_{bolt}$. Above all, however, because of the favorable lever ratios of the device according to the invention, both the magnitude of the resultant axle force $F_{res}$ and the magnitude of the coupling bolt force $F_{bolt}$ are substantially lower than in the known prior art for a predetermined valve force $F_{valve}$ and cam force $F_{cam}$.

What is claimed is:

1. An arrangement for operating intake and exhaust valves of an internal combustion engine having a cylinderhead with overhead valves and an overhead camshaft rotatably supported so as to extend longitudinally on said cylinderhead, said arrangement comprising at least one valve actuating lever and one coupling lever pivotally supported in side by side relationship on a lever support shaft extending parallel to said cam shaft, said coupling lever being in engagement with said camshaft along an engagement line for actuation of said coupling lever by a cam of said camshaft, said coupling lever and said valve actuating lever having guide bores with axes disposed at the same distance from the axis of said lever support shaft so that they can be brought into axial alignment, a coupling bolt disposed in said guide bores, actuating means for selectively moving said coupling bolt into and out of a coupling lever and valve actuating lever coupling position, a hydraulic valve clearance compensating element disposed in a bore formed at the end of said valve actuating lever, said lever support shaft having an axis of rotation and said guide bores having a center axis spaced from said axis of rotation of said lever support shaft by a distance which is greater than the distance between said guide bore center axis and the center axis of said valve clearance compensating element, wherein, in a coupled state of said coupling and valve actuating levers, the axis of rotation of said support lever shaft, the center axis of said guide bores, and the engagement line of said cam define in a plane transverse to the longitudinal axis of said cylinderhead approximately an isosceles triangle whose sides of equal length are formed by the distance between said engagement line and said axis of rotation of said lever support shaft and by the distance between the engagement line of said cam and said center axis, said camshaft being disposed between said intake and exhaust valves and at least partially above said valve actuating and coupling levers.

2. An arrangement according to claim 1, wherein, in a coupled state of said coupling and valve actuating levers, said distances between said axis of said lever support shaft, said center axis of said guide bores and the engagement line of said cam form, for each valve, approximately an equilateral triangle.

3. An arrangement according to claim 1, wherein, in a coupled state of said coupling and valve actuating levers, said coupling lever includes a motion transmission means in contact with said cam along an engagement line, and a plane receiving said engagement line and disposed normal to a plane defined by the axis of said lever support shaft and a straight line extending between the axis of said lever support shaft and the center axis of said guide bores defines the direction of the force acting on said coupling bolt in said plane transverse to the longitudinal axis of said cylinderhead.

4. An arrangement according to claim 1, wherein said hydraulic valve clearance compensating element-receiving bore in said valve actuation lever is located closely adjacent said guide bore in said valve actuation lever and an oil space is provided in said receiving bore around said valve clearance compensating element which is in communication, via a connecting oil passage, with an oil supply passage in said guide bore around said coupling bolt.

5. An arrangement according to claim 4, wherein said oil supply passages in said guide bore around said coupling bolt is in communication, via another oil passage with an oil supply passage extending through a support structure for said valve actuation lever.

* * * * *